US006347471B1

(12) United States Patent
Mirza

(10) Patent No.: US 6,347,471 B1
(45) **Date of Patent: *Feb. 19, 2002**

(54) TRANSPORTABLE SIGN OR MESSAGE HOLDER

(76) Inventor: Muhammad Zubair Mirza, 570 Farview Ave., Wyckoff, NJ (US) 07481

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 690 days.

(21) Appl. No.: 08/640,160

(22) Filed: Apr. 30, 1996

(51) Int. Cl.[7] ..... G09F 3/18

(52) U.S. Cl. ..... 40/661; 40/597; 40/649; 40/661.08; 40/594

(58) Field of Search ..... 40/594, 597, 649, 40/661, 661.06, 661.08, 766, 775, 776

(56) References Cited

U.S. PATENT DOCUMENTS

| | | | | | |
|---|---|---|---|---|---|
| 1,478,219 | A | * | 12/1923 | Hammitt | 40/661 X |
| 1,844,444 | A | * | 2/1932 | Schoolcraft | 40/649 |
| 2,151,359 | A | * | 3/1939 | Schmitz | 40/649 X |
| 2,755,576 | A | * | 7/1956 | Golden | 40/594 X |
| 2,930,154 | A | * | 3/1960 | Rosen | 40/1.5 |
| 3,237,327 | A | * | 3/1966 | Griggs | 40/600 |
| 3,618,238 | A | * | 11/1971 | Willinger | 40/661 |
| 3,914,890 | A | | 10/1975 | Behlen, Jr. | 40/64 R |
| 3,924,344 | A | | 12/1975 | Davis | 40/129 C |
| 4,051,615 | A | * | 10/1977 | Gosanko et al. | 40/661 |
| 4,144,661 | A | * | 3/1979 | Gosanko et al. | 40/661 |
| 4,171,584 | A | | 10/1979 | Kaiser | 40/490 |
| 4,301,608 | A | * | 11/1981 | Taylor, Jr. | 40/661 |
| 4,707,939 | A | | 11/1987 | Bonner et al. | 40/591 |
| 4,735,005 | A | * | 4/1988 | McMormick | 40/10 D |
| 4,736,539 | A | | 4/1988 | Dickinson | 40/591 |
| 4,810,544 | A | * | 3/1989 | Hickman | 428/40 |
| D304,737 | S | | 11/1989 | Mori | D20/42 |
| 4,953,315 | A | | 9/1990 | Romaine | 40/593 |
| 4,955,153 | A | | 9/1990 | Albrecht et al. | 40/661 |
| D318,494 | S | | 7/1991 | Bencivenga | D20/42 |
| 5,056,248 | A | * | 10/1991 | Blanchard | 40/322 |
| D321,374 | S | | 11/1991 | Whitlock et al. | D20/42 |
| D326,870 | S | | 6/1992 | Giammanco | D20/43 |
| 5,131,177 | A | | 7/1992 | Sy, Jr. | 40/593 |
| 5,235,768 | A | | 8/1993 | Eder | 40/488 |
| 5,241,768 | A | | 9/1993 | Thompson | 40/661 |
| 5,313,725 | A | * | 5/1994 | DeVassie | 40/312 |
| 5,330,261 | A | | 7/1994 | Bennett | 312/321.5 |
| 5,429,700 | A | * | 7/1995 | Hudson | 156/253 |
| 5,456,034 | A | * | 10/1995 | Lewis et al. | 40/661 X |
| 5,486,044 | A | | 1/1996 | Bennett | 312/321.5 |
| D405,119 | S | * | 2/1999 | Rellinger | D20/42 |

* cited by examiner

*Primary Examiner*—B. Dayoan
*Assistant Examiner*—Andrea Chop
(74) *Attorney, Agent, or Firm*—Jenkens & Gilchrist

(57) ABSTRACT

A transportable sign or message holder supports and displays replaceable signs or messages. A transparent front panel of polymeric material permits a sign or message to be viewed through the front panel. A rear panel, located behind the front panel, forms a cavity between the two panels and receives and supports a replaceable sign or message. The front and rear panels are attached at the bottom of the cavity and support the lower edge of a sign or message in the cavity. A pair of suction cups are mounted along the side edges for holding the two panels together and for detachably mounting the panels on a supporting structure.

19 Claims, 4 Drawing Sheets

TRANSPORTABLE SIGN OR MESSAGE HOLDER

FIELD OF THE INVENTION

The present invention relates generally to sign or message holders and, more particularly, to a transportable sign or message holder for supporting and displaying replaceable signs or messages.

SUMMARY OF THE INVENTION

It is a primary object of the present invention to provide a transportable sign or message holder that can be quickly and easily attached to, and detached from, any desired supporting surface without defacing that surface. A related object is to provide such a holder which permits the displayed sign or message to be easily replaced while the holder is attached to its supporting surface.

Another important object of this invention is to provide such an improved transportable sign or message holder that is capable of receiving a wide variety of signs or messages, typically printed on disposable media such as paper, paperboard or plastic film or sheets, or even personal or handmade signs or messages. A related object is to provide such a holder which permits the signs or messages to be easily replaced as frequently as desired.

A further object of this invention is to provide such an improved transportable sign or message holder which can be easily re-located and re-used as often as desired.

Yet another important object of this invention is to provide such an improved transportable sign or message holder which can be efficiently and economically mass produced, and which has a long useful life.

Still another object of this invention is to provide such an improved transportable sign or message holder which can be used to display signs or messages in a wide variety of different applications, including bumper signs or messages on vehicles, advertising signs or messages on windows of stores or vehicles, display booth signs and messages, and the like. In this connection, a related object of the invention is to provide such an improved holder that does not require any adhesive backing or other attachment material on the items inserted into the holder for display.

It is another object of this invention to provide such an improved transportable sign or message holder which can be easily tailored to display signs or messages in virtually any desired size, on virtually any desired surface. In this connection, a related object is to provide such an improved holder which enables the same sign or message to be displayed in a wide variety of different environments, including environments in which moisture may be present.

Still another object of this invention is to provide such an improved transportable sign or message holder which can be fabricated from only a few parts, e.g., a single sheet of plastic and a pair of fasteners.

A further object of the invention is to provide an improved sign or message holder that is capable of holding multiple copies of the displayed item, or even different displayed items, while also permitting the displayed items to be easily removed from the holder. Typical materials that can be displayed in this manner are work instructions, notes, reminders, bulletins, informational materials, coupons and other documents.

Another object of this invention is to provide an improved sign or message holder that protects wettable display materials from liquids (such as splashing) and soiling.

A still further object is to provide an improved sign or message holder that permits displayed materials within the holder to be viewed from opposite sides of the holder.

This invention is also intended to provide an improved sign or message holder that permits permanent displays on the holder itself, in addition to materials inserted into the holder.

Other objects and advantages of the invention will be apparent from the following detailed description and the accompanying drawings.

In accordance with the present invention, the foregoing objects are realized by providing a transportable sign or message holder for supporting and displaying replaceable signs or messages. The holder includes a transparent front panel of polymeric material that permits a sign or message to be supported and viewed through the front panel while protecting the sign or message from moisture and soiling. A rear panel located behind the front panel forms a cavity between the two panels for receiving, supporting and displaying one or more replaceable signs or messages, and the front and rear panels are attached at the bottom of the cavity for supporting the lower edge of a sign or message in the cavity. The holder includes mounting means for detachable mounting the panels on a supporting structure, such as a window or other flat solid surface.

In a preferred embodiment, the front and rear panels of the sign or message holder are formed by a single polymeric sheet that is folded to form the two panels, the fold forming the attachment between the two panels for supporting the sign or message in the cavity between the panels. Fastening devices are passed through the two panels near the side edges thereof to hold the two panels together while at the same time serving to attach the panels to a supporting surface. The preferred fastening devices are suction cups.

DETAILED DESCRIPTION OF THE PREFERRED EMBODIMENTS

Figure 1:
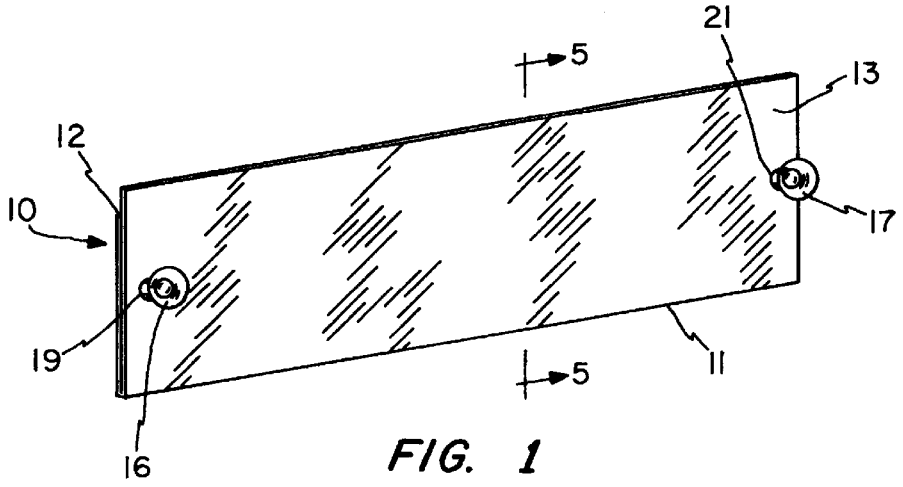
FIG. 1 is a front perspective of a sign or message holder embodying the invention.
Figure 2:
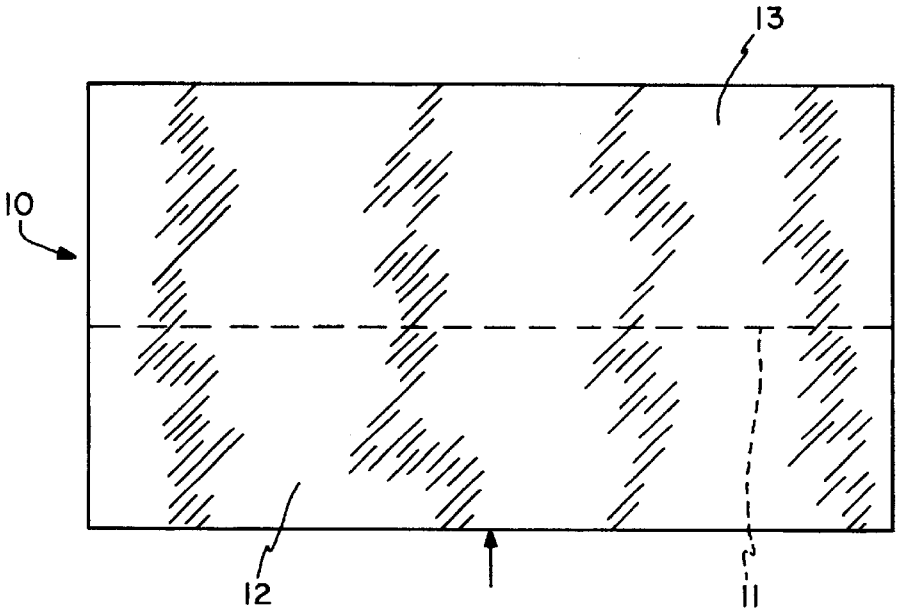
FIG. 2 is a planned view of a polymeric sheet used to form the holder of FIG. 1.

While the invention is susceptible to various modifications and alternative forms, certain specific embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Turning now to the drawings and referring first to FIGS. 1–5, a sign holder 10 is formed by folding a single sheet of transparent polymeric material along a fold line 11 to form a front panel 12 and a rear panel 13. Because the two adjacent panels 12 and 13 are open along their top edges, they form a cavity or pouch 14 between the two panels. When a sign 15 is inserted into the pouch 14, the front surface of the sign 15 can be viewed through the transparent front panel 12. The bottom edge of the sign 15 is supported by the fold in the polymeric sheet that forms the panels 12 and 13. A variety of different materials may be used to form the panels 12 and 13, but a preferred material is clear sheet stock of a material such as polyvinylchloride (PVC), Mylar, PETG or acetate. A particularly preferred material is PVC sheet stock having a thickness of approximately 0.010 inch.

Figure 3:
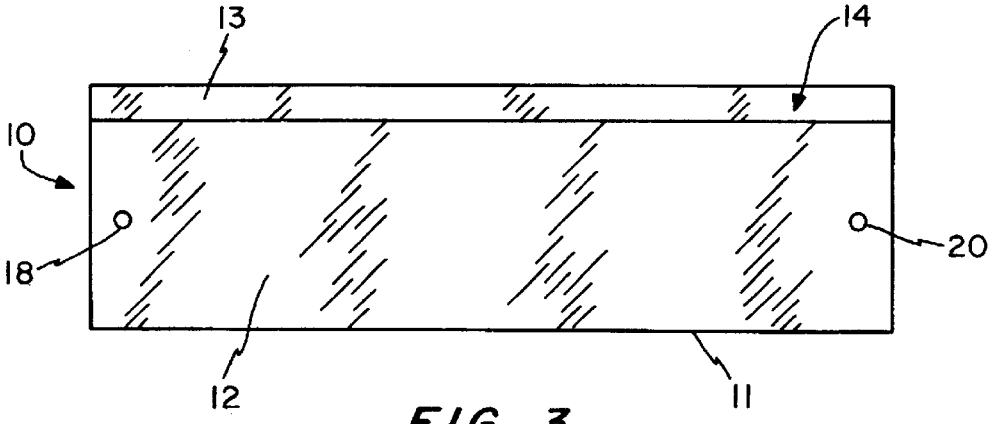
FIG. 3 is a planned view of the polymeric sheet of FIG. 2 after it has been folded and punched to form the holder of FIG. 1.
Figure 3A:
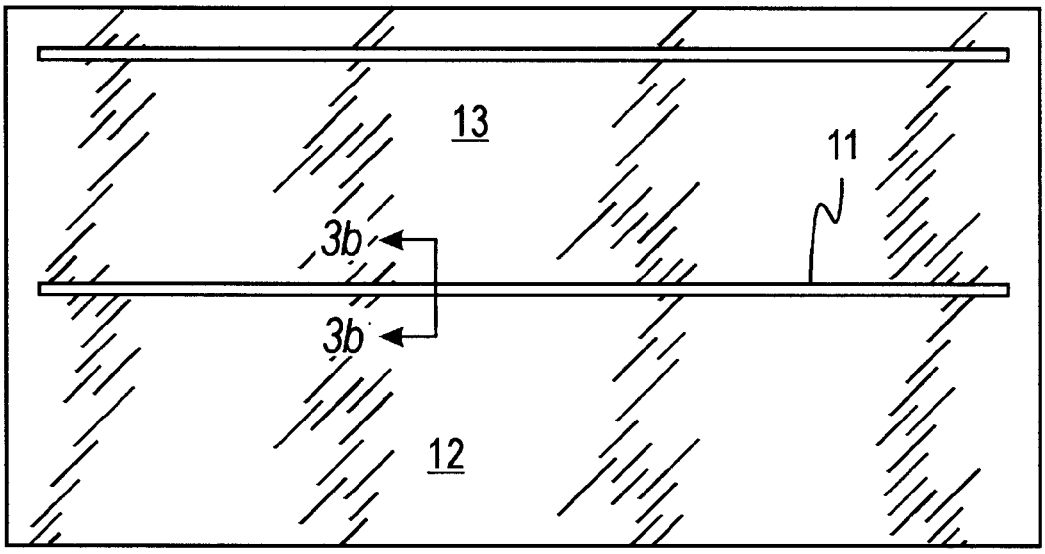
FIG. 3*a* is a plan view of the polymeric sheet used to form the article of FIGS. 1–3, showing the compression areas used to form the fold lines.
Figure 3B:
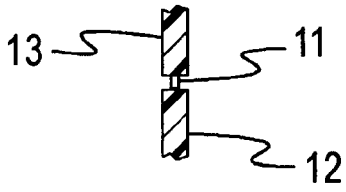
FIG. 3*b* is an enlarged section taken along line 3*b*–3*b* in FIG. 3*a;*
Figure 4:
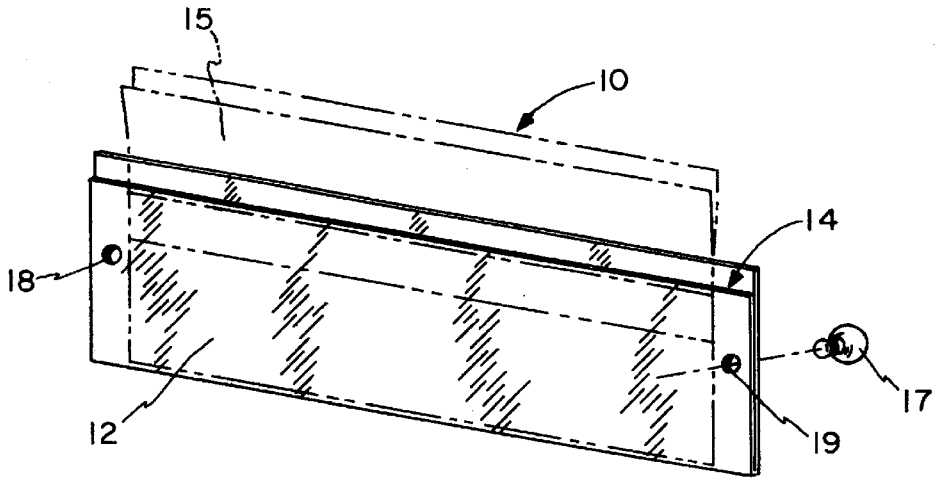
FIG. 4 is a front perspective view of the holder of FIG. 1, with signs or messages being inserted into the holder as illustrated in broken lines.
Figure 5:
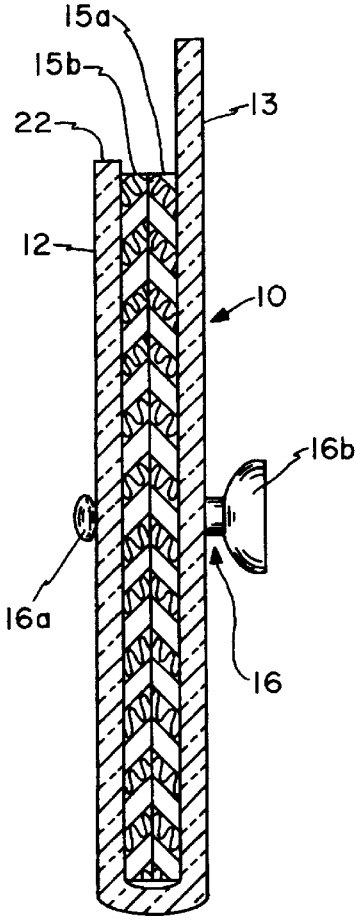
FIG. 5 is an enlarged section taken generally along line 5—5 in FIG. 1.

To facilitate the folding of the polymeric sheet to form the panels 12 and 13, the sheet may be compressed along a transverse line corresponding to the fold line 11 (see FIGS. 3*a* and 3*b*) This compression may be effected simultaneously with the cutting of the sheet from a larger sheet, by simply compressing the sheet along the fold line 11 to reduce the sheet thickness by a few thousandths of an inch along that line. The compression preferably terminates inboard of the side edges of the sheet so that the sheet is not susceptible to tearing along the fold line at the side edges of the sheet.

The sign 15 is typically a sheet of paper, paperboard or polymeric film having a printed or manually applied image on one or both sides. Although the term "sign" will be used throughout the description of the preferred embodiments of the present invention, it should be understood that the content of the printed matter is immaterial as far as the present invention is concerned. For example, one of the many applications for this invention is bumper "stickers", which are normally considered to be messages rather than signs. The present invention is useful with signs prepared on any flat media, regardless of content. Moreover, there is no need for any adhesive backing or other attachment medium on either surface of the sign 15, thereby minimizing the cost of preparation of the sign itself.

In the illustrative embodiment of the invention in FIGS. 1–5, lateral movement of the sign 15 within the pouch 14 is limited by a pair of suction cups 16 and 17 inserted through two pairs of mating holes 18, 19 and 20, 21 formed in the panels 12 and 13 adjacent the vertical side edges thereof The suction cups 16 and 17 are conventional, commercially available items which are molded to include integral holders 16*a*, 17*a* along with the actual suction cups 16*b*, 17*b*. The molded part is made of a flexible, resilient material so that it can be deformed to fit through a small opening such as the holes 18–21, after which it returns to its normal shape. The molded part necks in sharply between the holder and the base of the suction cup so that it is captured securely in the folded plastic sheet after insertion. The resulting assembly contains the side edges of the sign inserted into the pouch 14, to prevent the sign from escaping laterally from the pouch.

Figure 6:
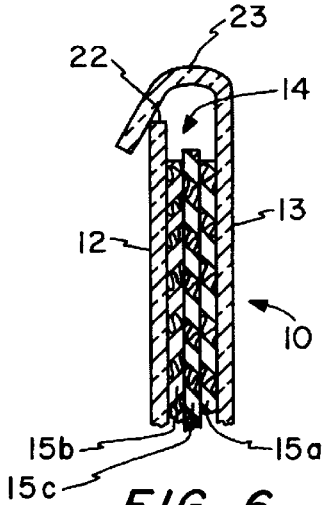
FIG. 6 is a fragmentary section similar to the top portion of FIG. 5 but illustrating a modified embodiment having a foldable top portion on the rear panel of the holder, and also illustrating the storage of a non-viewable display item between two viewable display items in the holder.

In the illustrative embodiment of FIGS. 1–5, the position of the fold line of the polymeric sheet is selected to form a rear panel 12 that is longer in the vertical dimension than the front panel 13. Consequently, the rear panel 13 extends vertically above the front panel 12 so that a portion 22 of the rear panel 13 extends above the top edge of the front panel 12. The top portion 22 of the rear panel 13 facilitates the insertion of the sign 15 into the thin cavity 14 by providing a guiding entry surface, and can also be used to display permanent messages printed on the sign holder 10 itself. As illustrated in FIG. 6, the top portion 22 may also be folded down over the top edge of the front panel 12 to close the top opening of the cavity 14 after a sign 15 has been inserted therein. To facilitate such folding, a second fold line 23, similar to the fold line 11, is preferably formed in the rear panel 13 at an elevation just slightly above that of the top edge of the front panel 12. Closing the top opening of the cavity 14 in this manner provides further protection against soiling and moisture, including rain, liquid splashing and the like.

It can be seen from the description thus far that the present invention can be implemented with only three parts. The resulting sign holder can be formed in a wide variety of different sizes and shapes, thereby accommodating a wide variety of different applications. This sign holder is particularly suited for the display of signs on exhibition booths and store windows, but it has a wide variety of other applications such as noncommercial window displays, personal displays of small messages such as on walls, refrigerators, computers, etc.

Although the preferred embodiment of the invention uses a single sheet of polymeric material to form both the front and rear panels 12 and 13, there may be no need for the rear panel 13 to be transparent. Consequently, the front and rear panels 12 and 13 may be made of different materials, with the rear panel 13 being made of a less expensive, non-transparent material. The two panels must still be attached to each other to support the sign 15 along its lower edge, and this attachment may be effected by a variety of different means such as adhesive, discrete fasteners, heat sealing, spot welding, etc.

When the holder 10 is mounted on a window or other transparent surface, it is often desirable to have both the front and rear panels 12 and 13 made of transparent material so that signs or messages in the cavity 14 can be viewed from both sides of the holder 10. In this case, two signs 15*a* and 15*b* (FIG. 5) are normally inserted into the cavity 14, one providing a display viewable through the front panel 12 and the other providing a display viewable through the rear panel 13. The cavity may also be used to store additional signs or messages 15*c*, as illustrated in FIG. 6, between the two viewable signs 15*a* and 15*b*. These additional items 15*c* may simply be extra copies of the viewable items for removal by the viewer, as the case of coupons, work instructions, bulletins and the like, or additional signs or messages to be displayed alternately or on different occasions.

Figure 7:
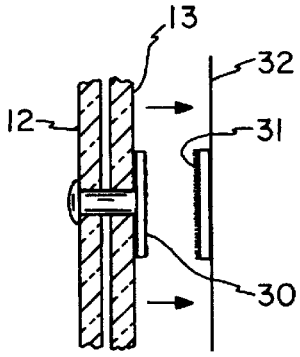
FIG. 7 is a fragmentary section similar to the middle portion of FIG. 5 but illustrating the use of an alternative fastening device.
Figure 8:
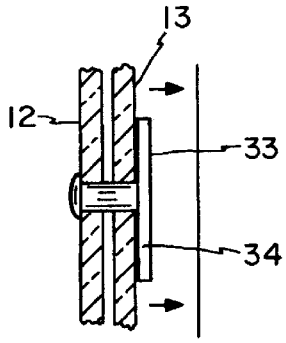
FIG. 8 is another fragmentary section similar to the middle portion of FIG. 5 but illustrating the use of another alternative fastening device.

The suction cups used as the side fasteners in the preferred embodiment may also be replaced with alternative fasteners. For example, the modified embodiment illustrated in FIG. 7 replaces the suction cups with conventional hook and loop fasteners, with the hook element 30 attached to the panels 12 and 13, and the loop element 31 attached to a supporting surface 32. The modified embodiment of FIG. 8 uses a coating of releasable adhesive 33 on the surface of a flat plate 34 attached to the two panels 12 and 13.

Figure 9:
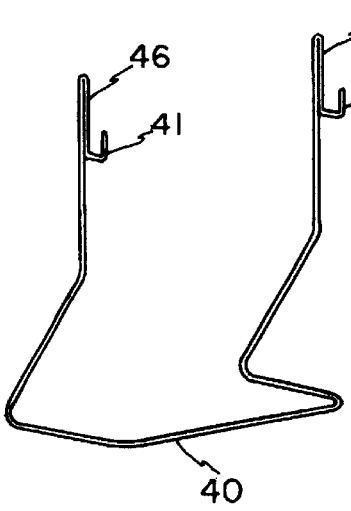
FIG. 9 is a perspective view of a support device for a holder embodying the present invention.
Figure 10:
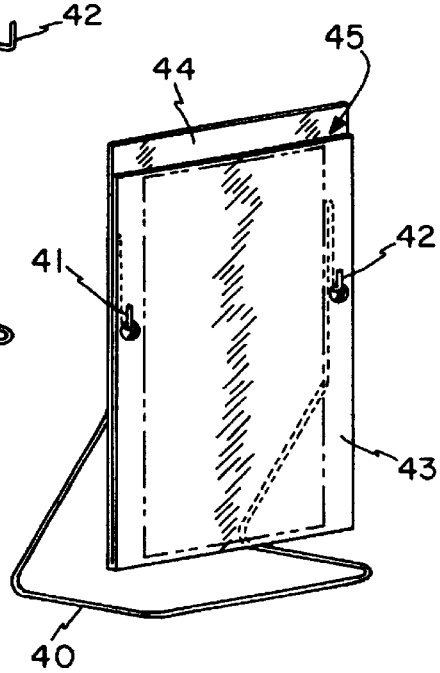
FIG. 10 is a perspective view of the support device of FIG. 9 with a sign or message holder mounted thereon.
Figure 11:
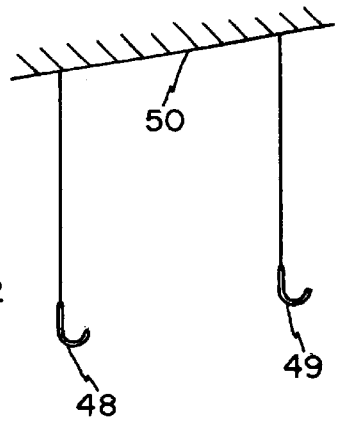
FIG. 11 is a perspective view of an alternative support device for a holder embodying the invention.

Fasteners which are easily removable from the panels 12 and 13. For example, a wire support stand 40 shown in FIGS. 9 and 10 includes a pair of hooks 41 and 42 that fit through two pairs of registered holes in a pair of panels 43 and 44 forming a cavity 45. The vertical elements 46 and 47 of the stand 40 hold the panels 43 and 44 in an upright position while they are supported on the hooks 41 and 42. A similar pair of hooks 48 and 49 suspended from a ceiling 50 are illustrated in FIG. 11. The sign or message holder to be suspended on the hooks 48 and 49 are preferably located near the top of the holder.

Separate fasteners may be used to attach the front and rear panels 12 and 13 to each other (to contain the sign 15 within the cavity 14), and to attach the sign holder 10 to the supporting surface on which it is mounted. For example, the two panels 12 and 13 may be attached to each other by means of adhesive, heat sealing, discrete fasteners, etc. The holder 10 may be attached to its supporting structure by the same means, or by the suction cups or other fastening devices employed in the preferred embodiments described above.

It should also be noted that the fastening means for attaching the sign holder to its supporting structure may be anchored to both the front and rear panels 12 and 13, as in the preferred embodiment described above, or to only the front panel 12, capturing the rear panel 13 between the front panel 12 and the supporting structure. In the case of holders that use separate fastening means to attach the front and rear panels to each other, the fastening means that attaches the holder to a supporting structure may be attached to only the rear panel if desired.

Figure 12:
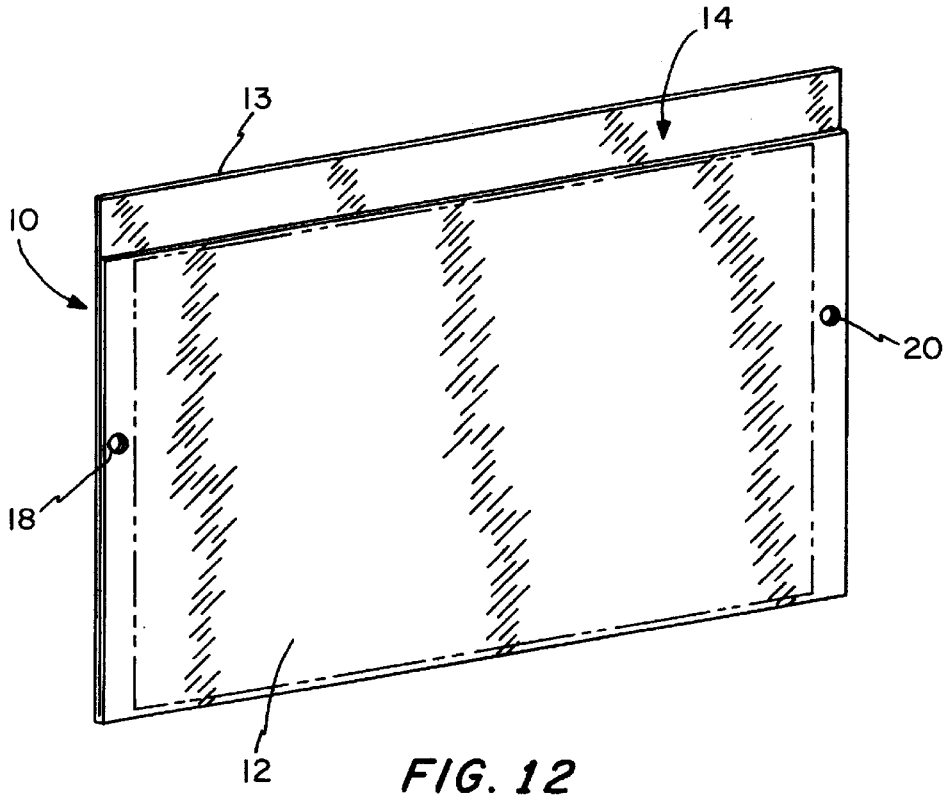
FIG. 12 is a front perspective view of a modified embodiment of a sign or message holder embodying the present invention.

One of the advantages of this invention is that the sign or message holder can be easily made with virtually any desired length-to-width ratio ("aspect ratio"). For example, the holder of FIG. 1 has an aspect ration much greater than one, while the holder of FIG. 10 has an aspect ratio less than one. FIG. 12 illustrates yet another embodiment having an aspect ratio of slightly less than 2:1. Thus, the holder of this invention can be readily tailored to display signs or messages of virtually any desired size and proportions.

What is claimed is:

1. A transportable sign or message holder for supporting and displaying replaceable signs or messages, said holder comprising a transparent front panel having a main body portion, a top edge, and side edges and made of flexible polymeric material that permits a sign or message to be viewed through the front panel, a rear panel having a main body portion, a top portion, a top edge, and side edges and made of flexible polymeric material that permits a sign or message to be viewed through the rear panel, said rear panel being located behind the front panel and detached from said front panel along the top edge of said rear panel and across at least most of the main body portions of said panels to form an open-top cavity between the two panels for receiving and supporting a replaceable sign or message, said cavity having a bottom, said front and rear panels being attached at the bottom of the cavity for supporting the lower edge of a sign or message in the cavity, the top edge of said rear panel being located above the top edge of said front panel, and mounting means for detachably mounting the panels on a supporting structure, said mounting means including a pair of suction cup holders having rear ends and passing through and connecting side edge portions of said panels to hold the side portions of the front and rear panels together and also limiting lateral movement of a sign or message received between the two panels, and a pair of suction cups attached to the rear ends of said suction cup holders wherein the flexibility of the polymeric material is such that the top edge of the rear panel may be folded downwardly over the top edge of the front panel and may also be unfolded to allow for replacing the sign or message.

2. The sign or message holder of claim 1 wherein said front and rear panels are formed by a single polymeric sheet that is folded to form the two panels, the fold forming the attachment between the two panels for supporting the sign or message.

3. The sign or message holder of claim 2 wherein said polymeric sheet is compressed along a transverse line to facilitate the folding of said sheet to form said panels.

4. The sign or message holder of claim 3 wherein the compression of said polymeric sheet along said transverse line terminates inboard of the side edges of said sheet to avoid tearing of the sheet along the fold line.

5. The sign or message holder of claim 1 wherein said rear panel is compressed along at least one transverse line located between the top edges of the front and rear panels to facilitate folding of the top portion of the rear panel downwardly over the top edge of the front panel.

6. The sign or message holder of claim 1 wherein said front and rear panels are substantially parallel and close to each other so that they support a non-self-supporting sign or message in a substantially flat and stable position.

7. The sign or message holder of claim 1 wherein the rear panel is transparent for viewing signs or messages.

8. The sign or message holder of claim 1 wherein the top portion of the rear panel facilitates the insertion of the sign into the cavity by providing a guiding entry surface.

9. The sign or message holder of claim 1 wherein the top portion of the rear panel is used to display permanent messages printed on the sign holder itself.

10. A transportable sign or message holder for supporting and displaying replaceable signs or messages, said holder comprising a transparent front panel having a main body portion, a top edge, and side edges and made of flexible polymeric material that permits a sign or message to be viewed through the front panel, a rear panel having a main body portion, a top portion, a top edge, and side edges and made of flexible polymeric material that permits a sign or message to be viewed through the rear panel, said rear panel being located behind the front panel and detached from said front panel along the top edge of said rear panel and across at least most of the main body portions of said panels, said front and rear panels forming an open-top pouch therebetween for receiving a replaceable sign or message, said pouch having a bottom, said front and rear panels also being attached at the bottom of the pouch for supporting the sign, the top edge of said rear panel being located above the top edge of said front panel, and fasting means for detachably fastening the panels to a solid surface behind the rear panel, said fastening means including a pair of suction cup holders having rear ends and passing through and connecting side edge portions of said panels to hold the side portions of the front and rear panels together and also limiting lateral movement of a sign or message received between the two panels, and a pair of suction cups attached to the rear ends of said suction cup holders wherein the flexibility of the polymeric material is such that the top edge of the rear panel may be folded downwardly over the top edge of the front panel and may also be unfolded to allow for replacing the sign or message.

11. The sign or message holder of claim 10 wherein said front and rear panels are formed by a single polymeric sheet that is folded to form the two panels, the fold forming the attachment between the two panels for supporting the sign or message.

12. The sign or message holder of claim 11 wherein said polymeric sheet is compressed along a transverse line to facilitate the folding of said sheet to form said panels.

13. The sign or message holder of claim 12 wherein the compression of said polymeric sheet along said transverse line terminates inboard of the side edges of said sheet to avoid tearing of the sheet along the fold line.

14. The sign or message holder of claim 10 wherein said fastening means comprises a pair of fastening means passing through the front and rear panels near the side edges thereof to hold the side portions of the front and rear panels together and also limiting lateral movement of a sign or message received between the two panels.

15. The sign or message holder of claim 10 wherein said rear panel is compressed along at least one transverse line located between the top edges of the front and rear panels to facilitate folding of the top portion of the rear panel downwardly over the top edge of the front panel.

16. The sign or message holder of claim 10 wherein said front and rear panels are substantially parallel and close to each other so that they support a non-self-supporting sign or message in a substantially flat and stable position.

17. The sign or message holder of claim 10 wherein the rear panel is transparent for viewing signs or messages.

18. The sign or message holder of claim 10 wherein the top portion of the rear panel facilitates the insertion of the sign into the cavity by providing a guiding entry surface.

19. The sign or message holder of claim 10 wherein the top portion of the rear panel is used to display permanent messages printed on the sign holder itself.

* * * * *